United States Patent [19]

McNeil et al.

[11] 4,058,399

[45] Nov. 15, 1977

[54] PHOTOSENSITIVE DIAZOTYPE MATERIAL AND METHOD OF MAKING THE SAME

[75] Inventors: Sharon S. McNeil; Carl R. Bloomquist; Robert C. Johnston, all of Binghamton, N.Y.

[73] Assignee: Defiance - Azon Corporation, Johnson City, N.Y.

[21] Appl. No.: 652,317

[22] Filed: Jan. 26, 1976

Related U.S. Application Data

[63] Continuation of Ser. No. 366,137, June 1, 1973, abandoned, which is a continuation-in-part of Ser. No. 104,991, Jan. 8, 1971, abandoned.

[51] Int. Cl.[2] ..... G03C 1/60; G03C 1/52

[52] U.S. Cl. ..... 96/75; 96/91 R; 427/424

[58] Field of Search ..... 96/49, 75, 91 R, 85, 96/87 R; 117/34; 427/424

[56] References Cited

U.S. PATENT DOCUMENTS

| | | | |
|---|---|---|---|
| 2,474,700 | 6/1949 | Slifkin | 96/75 |
| 2,801,919 | 8/1957 | Eichorn | 96/75 |
| 2,873,207 | 2/1959 | Weegar et al. | 96/75 |
| 2,999,016 | 9/1961 | Beeber et al. | 96/75 |
| 3,027,256 | 3/1962 | Klimkowski et al. | 96/75 |
| 3,163,535 | 12/1964 | Straw | 96/75 |
| 3,352,677 | 11/1967 | Kosalek | 96/75 |
| 3,370,949 | 2/1968 | Van Groenland | 96/75 |
| 3,520,242 | 7/1970 | Kemp et al. | 96/75 |
| 3,536,490 | 10/1970 | Hochberg | 96/75 |
| 3,627,563 | 12/1971 | Bollen et al. | 96/75 |

FOREIGN PATENT DOCUMENTS

| | | | |
|---|---|---|---|
| 1,915,759 | 10/1969 | Germany | 96/75 |
| 966,258 | 8/1964 | United Kingdom | 95/75 |
| 1,169,227 | 10/1969 | United Kingdom | 96/75 |
| 1,268,666 | 3/1972 | United Kingdom | 96/75 |

OTHER PUBLICATIONS

Kosar; J., "Light-Sensitive Systems", Wiley & Sons, 1965, pp. 300-301.

Poudrier; D., "Tappi", July 1963, vol. 46, No. 7, pp. 147A-150.

*Primary Examiner*—Charles L. Bowers, Jr.

*Attorney, Agent, or Firm*—Plumley and Tyner

[57] ABSTRACT

An erasable diazotype intermediate assembly comprising a translucent paper base, a rubber-like polymeric intervening barrier layer and a sensitizing layer consisting of a water soluble cellulose derivative, a cross linking resin and the diazo sensitizing chemicals.

2 Claims, 2 Drawing Figures

INVENTORS
SHARON S. McNEIL
CARL R. BLOOMQUIST
ROBERT C. JOHNSTON
BY

PHOTOSENSITIVE DIAZOTYPE MATERIAL AND METHOD OF MAKING THE SAME

RELATED APPLICATION

This application is a continuation of our application Ser. No. 366,137 filed June 1, 1973, now abandoned, which in turn is a continuation-in-part of application Ser. No. 104,991 filed Jan. 8, 1971, now abandoned.

BACKGROUND OF THE INVENTION

Diazo reproduction processes are based on light sensitive aromatic diazonium compounds and their ability to react with aromatic coupling components to form azo dyes under conditions of high pH. In one version of the diazotype process, the paper is coated with a solution containing the light sensitive aromatic diazonium compound and an acid, along with such other auxiliary components as may be deemed advantageous. After image-wise exposure of the sensitized paper, the coupling agent is supplied from a developer solution containing, in addition to the coupler, an alkaline-reacting substance.

In another version of the diazotype process, i.e. the two-component process, both the light sensitive aromatic diazonium compound and the coupling agent are coated on the paper along with an acid to prevent premature coupling. After image-wise exposure to ultraviolet light, during which the diazonium compound accessible to the light is decomposed, the dye image is formed by passing the print through an atmosphere of warm ammonia and water vapor. The acid of the coating is thus neutralized, creating the conditions for the coupling reaction to occur in those areas of the print where the diazo compound has not been decomposed by the action of the ultraviolet light during exposure.

Since it is frequently desirable to make a diazo print from which additional prints can be made at a later time, it is common practice to apply the sensitizing coating to a transparent base and to utilize diazo compounds and couplers which will yield a dye with strong absorption in the ultraviolet regions of the spectrum where aromatic diazonium compounds have their principle sensitivity. This type of diazo material is known as an "intermediate paper". When an ordinary diazo sensitized base is exposed to ultraviolet light through a print present on this intermediate paper, a contrasting image results since the dye forming the intermediate image has high "blocking power" to ultraviolet light while the paper base transmits these rays quite readily.

It is a common practice for draftsmen and designers to use diazotype intermediates for making changes and modifications in original designs. Accordingly, it is essential to be able to eradicate portions of the developed dye image. Prior art techniques for erasing such images have involved applying an excess of a liquid eradicator to the area to be bleached, followed by blotting. This method for eradication has obvious disadvantages in that it is inconvenient, time consuming, tends to weaken or even destroy the base, and leaves a poor surface for subsequent pencil or ink redrawing.

In addition, it is the usual practice in the diazotype coating industry to apply the solution to a moving web of paper by means of an applicator roller turning in a tray of the solution. The excess is then "doctored off" by means of a jet of air. Such a technique, however, has the tendency to cause the formation of streaks in the final coating originating at the applicator roller. Various adjustments made in the coating operation have not been completely successful in eliminating these streaks.

SUMMARY OF THE INVENTION

It is the primary object of this invention to prepare a photosensitive diazotype assembly which provides an image of high contrast, of good reprint quality, and which, in addition, is readily erased with a conventional soft rubber eraser.

It is a further object to provide a diazotype assembly which will function as an intermediate in the production of additional prints of the original design.

Various other objects and advantages of this invention will be apparent from the following detailed description thereof.

It has now been found that a photosensitive diazotype assembly which provides an image of high contrast, good reprint quality and image erasability can be prepared by coating the surface of a translucent paper base which has been rendered impermeable by means of a rubber-like polymeric barrier layer with a sensitizing layer comprising a matrix of a water soluble cellulose derivative and a cross linking resin containing the appropriate diazo sensitizing chemicals. The resulting product provides excellent image reproduction. Furthermore, the developed dye image can be easily erased with the use of a conventional soft rubber pencil eraser (Type I, Grade A, described in Federal Specification ZZ-E-00661F), thereby overcoming the disadvantages inherent in the prior art eradicating techniques which required the use of bleaching liquids.

We theorize that the erasability of the developed image arises in the following manner: the rubber eraser during the first few strokes breaks through the film of the sensitizing layer which has been rendered harder and more brittle by the cross linking resin contained therein, after which the high coefficient of friction between the rubber of the eraser and the rubber-like underlying barrier layer causes the entire coating composition to be cleanly removed from the surface of the paper in those areas to which the eraser has been applied.

Difficulties in preparing such products, such as streaking, are also overcome in the instant invention inasmuch as the assembly is prepared by passing the impervious web over a fountain of sensitizing solution and then utilizing air to remove the excess solution. It should also be noted that the sensitizing layer is applied from an aqueous solution, thereby avoiding the difficulties inherent in the use of organic solvent solutions.

The invention is more specifically defined in the appended claims read together with the following description and the accompanying drawings thereof in which FIG. 1 is an enlarged, cross-sectional view of a typical diazotype assembly of this invention;

FIG. 2 is a schematic illustration of the preferred procedure for applying the sensitizing solution.

DESCRIPTION OF THE PREFERRED EMBODIMENTS

Figure 1:
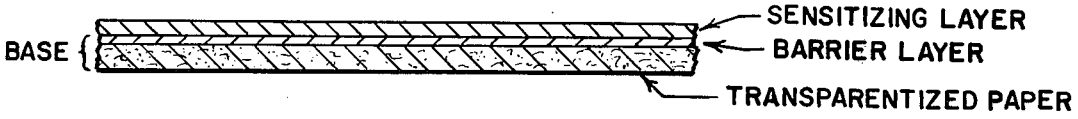

Since the diazotype construction of this invention functions as an intermediate paper, it is essential that the paper base utilized therein be capable of transmitting light rays. Accordingly, for purposes of the specification and claims, the term "transparentized base" will be used to denote the applicable light transmitting paper bases whether such bases are naturally transparent, translucent or treated to produce the desired light transparency.

As previously indicated, the base is provided with an impervious surface in order to prevent penetration of the sensitizing solution. Such penetration is particularly undesirable inasmuch as it hinders removal of the subsequently developed azo dye image. The barrier coat should be a flexible coating which allows at least partial transmission of light. It is preferably applied as an aqueous emulsion of a suitable material although it can be applied as a plastisol or the like. Natural rubber, synthetic rubber such as neoprene, butadiene-styrene, butadiene-acrylonitrile, and the like, have been found particularly useful for this purpose. As a general rule, the barrier coat will be applied in a thickness of from about 0.1 to 0.2 mil.

The sensitizing layer which is applied in face-to-face contact with the rubber-like intervening barrier layer comprises a water soluble cellulose derivative and a water soluble cross linking resin containing a light-sensitive aromatic diazonium compound, an azo coupler, an acid and such other auxiliary chemicals as are advantageous for improving contrast, shelf-life, ease of development, etc. The sensitized layer will be deposited from an aqueous solution in a thickness ranging from about 0.2 to 0.3 mil. It should be noted, however, that for purposes of viscosity control, lower alcohols such as isopropanol can be present in the aqueous solution. The class of water soluble cellulose derivatives which has been found particularly useful is the water soluble cellulose ethers such as methyl cellulose, carboxymethyl cellulose, hydroxyethyl cellulose, hydroxypropyl cellulose and hydroxyisopropyl cellulose. Coating solutions which contain 2–6%, by weight, of the above mentioned cellulose derivatives along with the usual sensitizing chemicals yield useful sensitized layers. Furthermore, since the usual techniques for the application of diazotype coatings to the backing web require that the viscosity of the coating solution be less than approximately 75 centipoises, at a temperature of 20° C., only those soluble cellulose derivatives which yield solutions of this visocity or less at the above specified concentrations are useful in the invention.

Any of the diazo materials well known to those skilled in the art are suitable for use in this invention. The diazo compounds are generally stabilized halogeno salts of a diazonium derivative of a p-phenylene-diamine such as N,N-diethyl-p-phenylenediamine, N-dimethyl-p-phenylenediamine, N,N-dipropyl-p-phenylenediamine, 2,5-diethoxy-4-morpholino-aniline, 2,5-dimethoxy-4-morpholino aniline, 2,6-dimethyl-4-morpholino aniline, 2,5-diethoxy-4-piperidino aniline and 2,5-diethoxy-4-pyrrolidino benzene.

Some suitable couplers include: phenols, catechols, resorcinols, aceto acetanilides, derivatives of these compounds, and the like.

Acids which may be present in the sensitizing layer in order to prevent premature coupling include organic acids with acid constants ($pK_a^{25°}$) ranging from about 2.5 to 4.5 such, for example, as citric acid, tartaric acid, lactic acid and the like.

The concentration of diazo material, coupling agent and acid in the sensitizing solution is determined on the basis of the stoichiometric equivalencies of the coupling reaction.

In order to avoid tackiness or sensitivity to moisture in the sensitized layer, the addition of a water soluble cross-linking resin is desirable. For this purpose, from about 0.5–4%, by weight, of a urea formaldehyde or melamine formaldehyde resin may be incorporated in the sensitizing solution. The resultant matrix of cross linked cellulose derivatives has excellent properties of erasability and freedom from tack.

It has also been found that erasability may be further improved by the incorporation of 1–8%, by weight, of silica in the coating solution. For this purpose, the silica should exhibit an average particle size in the range of about 1–10 microns. In addition to improved erasability, silica substantially improves the image contrast and causes the coupling reaction to occur more readily even within the very brief passage of the exposed print through ammoniacal atmosphere. The contrast of a print obtained through the paper intermediate is also improved when silica is used in the coating formulation.

The sensitized layer may also contain additional components used in diazo preparations such as stabilizers, extenders, color intensifiers, antioxidants and inhibitors.

Figure 2:
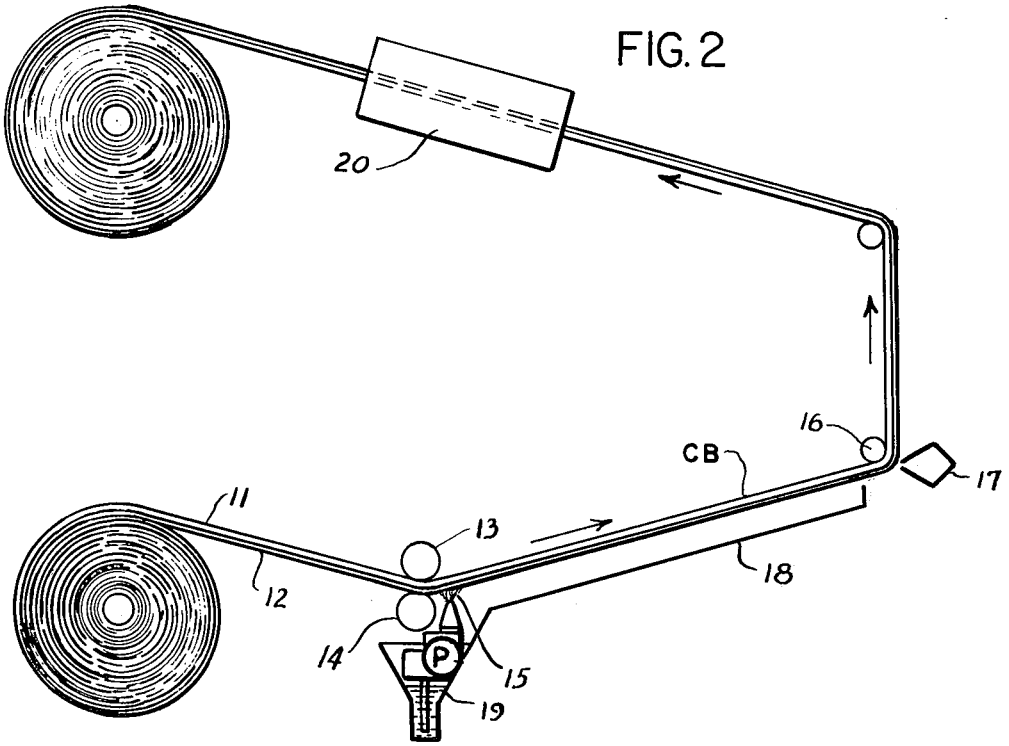

The novel method of this invention for applying the sensitized coating involves directing a fountain of the aqueous sensitizing solution against the impervious surface of the transparentized base, removing excess solution by means of an air doctor and then drying the coated base. The term "fountain" as related to the coating arts is defined as an unrestricted flow of coating solution in an upward direction impinging on the moving web. This procedure is clearly depicted in FIG. 2 wherein the transparentized base 11, which in this instance is rendered impermeable by the presence of barrier layer 12, is passed between rollers 13, 14 and then over the fountain of sensitizing solution 15 in such a manner that the top of the fountain 15 makes contact with the barrier layer 12. The coated base CB is then passed at an ascending angle to back-up roller 16 where it is contacted with a stream of air issuing from air doctor 17 in order to remove excess solution. The excess solution is caught by tray 18 and then runs back into catch basin 19 for return to the fountain 15. The coated base CB is then passed through a suitable drier 20, thereby yielding the desired photosensitive diazotype assembly. (FIG. 1)

As previously indicated, the assembly is exposed to an appropriate light source through a light transmitting original and then passed through a heated chamber containing an atmosphere of ammonia and water vapor in order to develop the colored image. The resulting intermediate can be readily used for the preparation of additional prints. The developed images can be easily corrected or changed by the use of a conventional eraser.

The following examples will further illustrate the novel embodiments of this invention. In these examples, all parts given are by weight unless otherwise noted.

EXAMPLE I

This example illustrates the preparation of the novel diazotype construction of this invention.

The base utilized was 100% rag paper which had been impregnated with a polystyrene resin to render it translucent. The base was coated, in a 0.1–0.2 mil thickness, with a barrier layer consisting of an aqueous styrene-butadiene emulsion. Upon drying the coated base, the following sensitizing solution was applied over the barrier layer:

| | Parts |
|---|---|
| Water | 4280 |
| Isopropanol | 4200 |
| Citric acid | 200 |
| Formic acid | 250 |
| Thiourea | 200 |
| Resorcinol | 180 |
| 1-Morpholino-2,5-diethoxy-benzene-4-diazonium chloride, ½ zinc chloride | 260 |
| Zinc chloride | 200 |
| Hydroxypropyl Cellulose | 300 |
| Silica (4 micron) | 600 |
| Melamine-formaldehyde | 100 |

The solution, which had a viscosity of 50 centipoises at 20° C., was applied by means of a fountain directed at the underside of the moving web. The excess solution was removed by means of an air doctor, whereupon the paper was dried. The dried sensitized layer had a 0.2–0.3 mil thickness.

The resulting diazotype intermediate was then exposed to ultra-violet radiation from a fluorescent tube through a translucent original and developed by being passed through an atomosphere of ammonia and water vapor at 95° C. An excellent sepia colored azo dye image was produced on the translucent white background. The image was readily erased with a conventional soft rubber pencil eraser.

EXAMPLE II

The general procedure set forth in Example I, hereinabove, was repeated with the exception that the following sensitizing solution was utilized in the preparation of the diazotype construction.

| | Parts |
|---|---|
| Methyl cellulose | 200 |
| Isopropanol | 4800 |
| Water | 3200 |
| Silica (4 micron) | 175 |
| Saponin | 20 |
| Citric acid | 100 |
| Resorcinol | 46 |
| 4-Chlororesorcinol | 57 |
| N,N dimethylaniline-4-diazonium chloride, zinc chloride double salt | 200 |
| Zinc chloride | 60 |
| Melamine-formaldehyde | 50 |

The resulting intermediate was exposed through a pencil drawing on translucent paper to the radiation from a high pressure mercury vapor lamp and developed in ammonia and water vapor at approximately 95° C., yielding a sepia colored image with excellent reprint quality. The image was readily erased with a conventional soft rubber pencil eraser.

EXAMPLE III

The 100% rag transparentized paper base described in Example I was coated, in a 0.1–0.2 mil thickness, with a barrier layer consisting of an aqueous polyethylene emulsion. Upon being dried, the paper based was coated with the following sensitizing solution (45 cps. at 20° C.) according to the procedure described in Example I.

| | Parts |
|---|---|
| Hydroxyethyl cellulose | 180 |
| Isopropanol | 4500 |
| Water | 5500 |
| Silica (4 micron) | 200 |
| Citric Acid | 100 |
| Resorcinol | 53 |

-continued

| | Parts |
|---|---|
| 4-Chlororesorcinol | 70 |
| N,N dimethyl aniline-4-diazonium chloride, zinc chloride double salt | 170 |
| Zinc chloride | 100 |
| Melamine-formaldehyde | 250 |

The resulting intermediate gave prints of good contrast and good reprint quality. The image was readily erasable with a conventional soft rubber pencil eraser.

EXAMPLE IV

The procedure set forth in Example III was repeated with the exception that the following sensitizing solution was utilized in the preparation of the diazotype intermediate.

| | Parts |
|---|---|
| Hydroxyethyl cellulose | 190 |
| Isopropanol | 4500 |
| Water | 5500 |
| Silica (4 micron) | 100 |
| Citric Acid | 100 |
| Resorcinol | 60 |
| 4-Chlororesorcinol | 60 |
| N,N diethylaniline-4-diazonium chloride, zinc chloride double salt | 185 |
| Zinc chloride | 80 |
| Melamine-formaldehyde | 200 |

The performance characteristics of the resulting intermediate were comparable to those of the product prepared in Example III.

EXAMPLE V

The procedure of Example III was once again repeated utilizing the following sensitizing solution.

| | Parts |
|---|---|
| Methyl cellulose | 200 |
| Isopropanol | 4000 |
| Water | 4000 |
| Urea Formaldehyde | 200 |
| Citric acid | 300 |
| 4-Chlororesorcinol | 280 |
| N,N dimethylaniline-4-diazonium chloride, zinc chloride double salt | 260 |
| Zinc chloride | 400 |

While exhibiting good print properties, the resulting intermediate showed somewhat reduced erasability, this factor being attributed to the absence of silica from the sensitizing solution.

Among the prior art material that may be referred to for additional background information on diazo reproduction processes and, in particular, on various aspects of the instant invention are included: U.S. Pat. Nos. 2,423,768; 2,646,363; 3,235,443; 2,861,008; 3,418,469; and German Application No. 1,915,759, published Oct. 16, 1969.

Summarizing, it is thus seen that this invention provides for the preparation of novel photosensitive diazotype assemblies.

Variations may be made in proportions, procedures and materials without departing from the scope of the invention as defined by the following claims.

What is claimed is:

1. A diazotype intermediate assembly which is easily erasable with a conventional soft rubber pencil eraser comprising a transparentized paper base coated with a barrier layer of a rubber-like polymeric material which barrier layer is overcoated with a sensitizing layer; in which said sensitizing layer is obtained by overcoating the barrier layer with an aqueous sensitizing solution consisting essentially of 2–6% by weight of a water soluble cellulose derivative; 0.5–4% by weight of a water soluble melamine-formaldehyde or urea-formaldehyde cross-linking resin; a light sensitive aromatic diazonium compound; an azo coupling agent; an organic acid having a $pKa^{25}$ value of from 2.5 to 4.5; and 1–8% by weight of silica having a particle size of 1–10 microns in an amount sufficient to improve the erasability of said diazotype intermediate assembly compared to the assembly containing no silica; water and an amount of a lower alcohol equal to or less than the amount of water.

2. A process for preparing an erasable photosensitive diazotype assembly comprising steps of:

a. coating a transparentized base with an aqueous emulsion of a rubber-like polymer material and drying to form a barrier layer;

b. overcoating said barrier layer with a sensitizing layer by passing said barrier layer over a fountain of an aqueous sensitizing solution having a maximum viscosity of 75 centipoises at 20° C in contact therewith, such that the top of the fountain contacts the barrier layer surface; said aqueous sensitizing solution consisting essentially of 2–6% by weight of a water soluble cellulose derivative; 0.5–4% by weight of a water soluble melamine-formaldehyde or urea-formaldehyde cross-linking resin; a light sensitive aromatic diazonium compound; an azo coupling agent; an organic acid having a $pKa^{25}$ value of from 2.5 to 4.5; and 1–8% by weight of silica having a particle size of 1–10 microns sufficient to improve the erasability of said diazotype intermediate assembly compared to the assembly containing no silica; water and an amount of a lower alcohol equal to or less than the amount of water.

* * * * *